US006266825B1

(12) United States Patent
Floyd

(10) Patent No.: US 6,266,825 B1
(45) Date of Patent: Jul. 31, 2001

(54) TRAVELER'S HEAD SUPPORT SLEEPING AND RESTING HARNESS

(76) Inventor: Glenn Floyd, Apt. 4, #1 Park Street, South Yarra 4131 Victoria (AU)

( * ) Notice: Subject to any disclaimer, the term of this patent is extended or adjusted under 35 U.S.C. 154(b) by 0 days.

(21) Appl. No.: 09/548,887

(22) Filed: Apr. 13, 2000

(51) Int. Cl.[7] ..... A41D 20/00

(52) U.S. Cl. ..... 2/338; 2/311; 297/393

(58) Field of Search ..... 2/1, 311, 312, 2/338, 308, 317, 331, 336, 335, DIG. 11, 171, 171.8, 455, 456; 280/748, 801, 808; 244/122 R, 122 A, 122 AG, 122 B; 297/464–466, 468, 486, 393, 391, 392, 397, 398, 399, 400, 406, 217

(56) References Cited

U.S. PATENT DOCUMENTS

| | | | | |
|---|---|---|---|---|
| 2,726,714 | * | 12/1955 | McAndrews | 297/464 |
| 3,897,777 | * | 8/1975 | Morrison | 128/869 |
| 4,205,670 | * | 6/1980 | Owens | 128/875 |
| 4,339,151 | * | 7/1982 | Riggs | 297/464 |
| 4,607,885 | * | 8/1986 | Fierro | 297/397 |
| 4,707,031 | * | 11/1987 | Meistrell | 297/393 |
| 5,081,714 | * | 1/1992 | Liu | 2/338 |
| 5,378,042 | * | 1/1995 | Daneshvar | 297/383 |
| 5,395,158 | * | 3/1995 | Cordia | 297/393 |
| 5,539,933 | * | 7/1996 | Garber et al. | 2/311 |

* cited by examiner

*Primary Examiner*—Gloria M. Hale
(74) *Attorney, Agent, or Firm*—N Paul Friederichs; Angenehm Law Firm

(57) ABSTRACT

Disclosed is a traveler's head support sleeping and resting mechanism for a seated person. The seat and/or chair being used may include a headrest. The present invention includes a band comprising two separate sections, a seat harness and a head harness. When the two separate sections are in contact with each other's highly adhesive sides, a single band is formed. When the seat harness is wrapped around the top section of the seat and/or chair to overlap on itself, creates a strong anchoring seat harness section around such seat an/or chair. The head harness, the remaining length of band section, may be further wrapped around the seated person's forehead and the seat anchoring harness section itself. The two separate sections are strongly bonded on contact with each other and themselves so as to form a comfortable, complete head support harness. The present invention provides support for restraining the user's head against forward and/or lateral side-to-side movement relative to the position of the person's head against the headrest.

18 Claims, 2 Drawing Sheets

10
22
40
30
20

50

22
30
40
10
20

20
50

30
22
10
40

TRAVELER'S HEAD SUPPORT SLEEPING AND RESTING HARNESS

FIELD OF INVENTION

This invention relates generally to head supports. More specifically, this invention relates to devices for supporting the head comfortably and firmly at rest, for the purpose of sleeping and/or resting, traveling in aircrafts, busses, trains, trucks, cars and/or other vehicles.

BACKGROUND

For many people, the inability to sleep or rest as a traveling passenger on aircraft causes the documented medical disability of jetlag. This can cause sickness and the condition often has severe debilitating physiological, psychological and emotional symptoms of long-term duration.

In addition, a similar malady occurs to travelers on long haul journeys in busses, trucks, trains, cars and other vehicles, often resulting in extremely severe discomfort. Chronic symptoms of, tiredness irritability and physical and emotional exhaustion frequently occur. This syndrome arises, when sleep and absolute rest are prevented by the long journey, extending traveling through natural sleeping times.

The professional long haul bus and truck transport industry recognizes this hazardous phenomenon, and as part of corporate policy and for Occupational Health and Safety legal compliance; schedules compulsory driver and driver's assistant sleep and rest breaks. This policy is necessary to avoid such symptoms leading to travel exhaustion, as these severe symptoms may cause accidents leading to death.

Further major physiological conditions suffered by travelers, are severe neck strain, chronic neck-ache and badly stretched and cramped neck muscles, often requiring chiropractic or physiotherapeutic intervention and/or convalescence to recover. This arises from involuntary neck movement, and/or neck jerking, and/or neck stretching after falling asleep from exhaustion through lack of sleep, on such journeys.

There has been many past passenger seat design proposals with focus on seat headrest design modification to improve passenger head comfort. This focus has been to improve comfort, not to provide head support, to allow sleep. This focus has been on head support design modification by providing 'slightly protruding' winged head supports. These seat designs however, are in extreme conflict with passenger ergonomics operating on passengers, while traveling. The major conflict is that the protrusion forward of the wings on the head support cannot be so prominent that it blocks peripheral vision. Accordingly, the limited winged head support protrusion design is inadequate for supporting the head. This protrusion however is not a design function for head support; it is a headrest, not a head support.

There are also a number of portable quasi head type supports available, such as small neck cushions, shaped, neck collar-type rests and inflatable neck pillows. Although these designs attempt to focus on addressing head support for sleep and rest, the support provided is limited. They do not support the head, as the head requires absolute minimal movement for natural sleep to be possible. These devices therefore only providing limited support and are neck comfort rests, not head supports.

If the passenger needs to sleep or take complete rest with these limited devices, the passenger must rely on neck muscle and tendon structure to support the head to prevent it from involuntarily moving thereby causing the passenger to remain awake, increasing exhaustion. These devices provide only limited support and if sleep does occur, the head is able to sway and fall in motion jerking movement often severely during travel risking strain, soreness and/or injury. With these devices, the risk of assuming that adequate support is being provided when it indeed may not be may constitute a health hazard. This risk may arise, as significant support may not be provided when it is expected and relied upon.

IN THE DRAWINGS

SUMMARY

The present invention is unique in that it is comprised from a band of a two strap assembly arrangement with highly adhesive contact surfaces whereby the two length of strap are contacted to form one length only. This unique arrangement allows the full strap assembly to universally fit any seat with a headrest type section and/or fit any person. This unique arrangement does not need any other fixing arrangements whatsoever, such as buckles, etc., to form a head support for restraining the user's head against forward and/or lateral side-to-side movement relative to the position of the person's head against the headrest when used with any seat.

The problems with the prior art are overcome by the present invention. The present invention provides a fully adjustable head support sleeping and resting harness. The present invention includes a non-resilient firm tensioning strap assembly able to be fastened at universally adjustable junctures. The present invention is able to be adapted to fasten the strap assembly on to itself by gripping the strap at variable positions. The strap assembly thereby being able to be universally adjusted to suit to any seat with a headrest type section to form a head support for restraining the user's head against forward and/or lateral side-to-side movement relative to the position of the person's head against the headrest.

In one form of the present invention the non-resilient, firm tensioning strap assembly includes material of a nylon type webbing, having a contact surface highly adhesive to its opposite side throughout its operating life. The contact surfaces remain highly adhesive and grip in a bond strongly to each other irrespective of the number of times the surfaces are brought-into or removed-from contact with each other. The present invention is a strap assembly design and its universal adaptability to any seat with a headrest type section. The manner the present invention comfortably and firmly supports the head at rest to form a head support for restraining the user's head against forward and/or lateral side-to-side movement relative to the position of the person's head against the headrest is also new.

In one form of the present invention, the strap assembly has universal adaptability to fitting any seat, existing or proposed. The lengths of the strap assembly are sufficiently long to be affixed to the largest of seats and may be simply modified for smaller seats (if required) by overlapping the strap assembly and taking up the slack.

A feature of the non-resilient, firm tensioning strap assembly described herein is to have a terry toweling surface bearing on the forehead. This feature is a cushion supplied for comfort and is provided in the form of a terry toweling sleeve which slips over the tensioning strap assembly, head harness section and can easily be removed for laundering and re-use.

DETAILED DESCRIPTION

Figure 1:
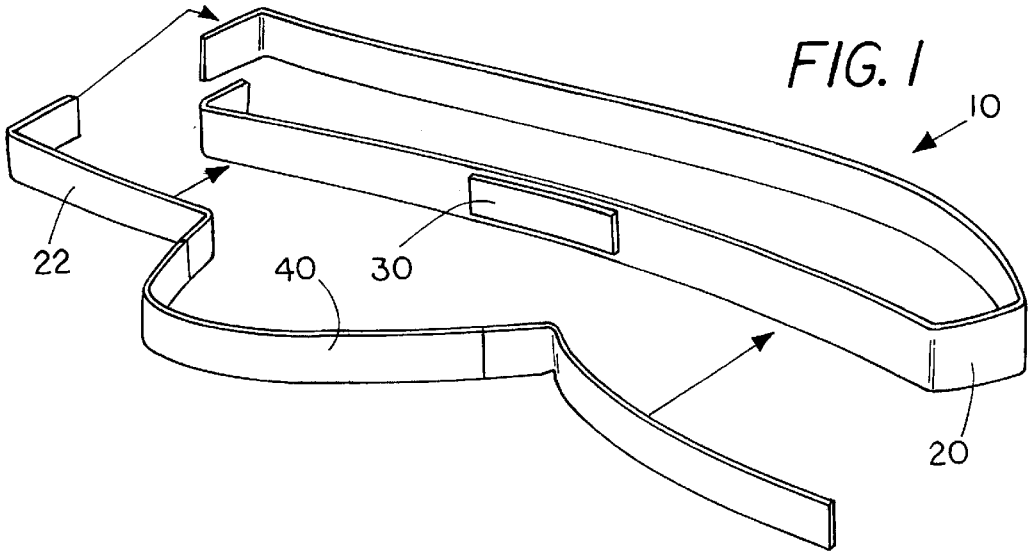
FIG. 1 is a plan view of the present invention.

In FIG. 1, the present invention 10 is shown. One example of a head support sleeping and resting harness assembly, according to this invention is shown. FIG. 1 indicates by three-dimensional view, all parts separated and to be fitted in to place on a universal seat with a headrest type section. The drawing does not show the typical universal seat.

Figure 2:
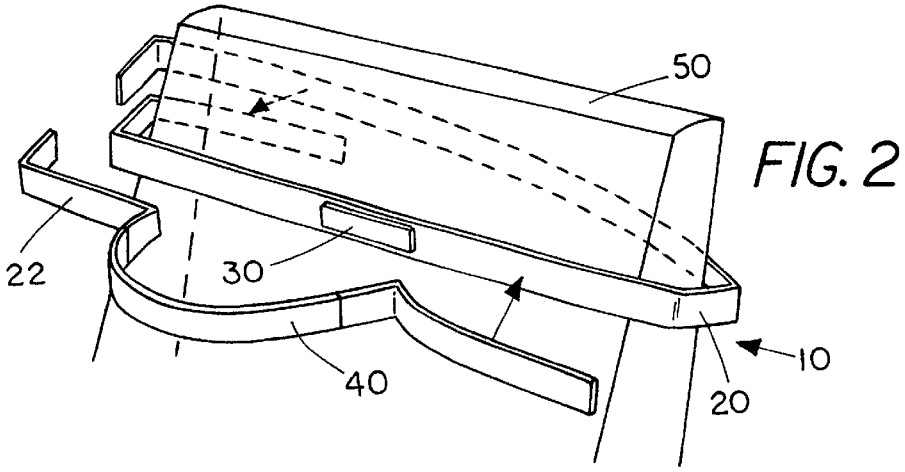
FIG. 2 is an expanded front view of the present invention.

In FIG. 2, the operational fitting application of such a head support sleeping and resting harness assembly is shown. FIG. 2 indicates by three-dimensional view, all parts separated and to be fitted in to place on a universal seat with a headrest type section. FIG. 2 also shows a partially exploded view of the back of the typical universal seat and how such fitting is to be so effected.

Figure 3:
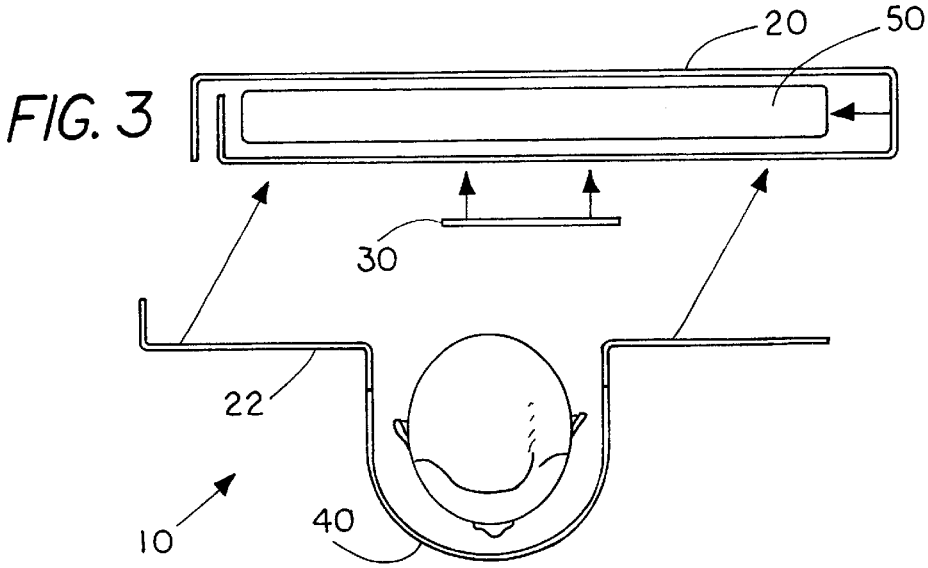
FIG. 3 is an expanded top view of the present invention.

FIG. 3 shows in top elevation, all parts separated and to be fitted in to place on a universal seat with a headrest type section. FIG. 3 shows the top of a typical universal seat with a headrest section.

Figure 4:
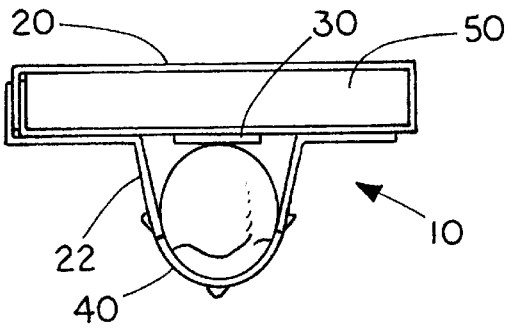
FIG. 4 is a top elevation view of the present invention.

FIG. 4 shows in top elevation, the operational fitting application of such a head support sleeping and resting harness assembly, fully fitted in to place on a universal seat with a headrest type section. The full fitting also includes the drawing of the head of a human figure. The drawing also shows an aerial view of the typical universal seat with headrest section and how such fitting is to be effected.

Figure 5:
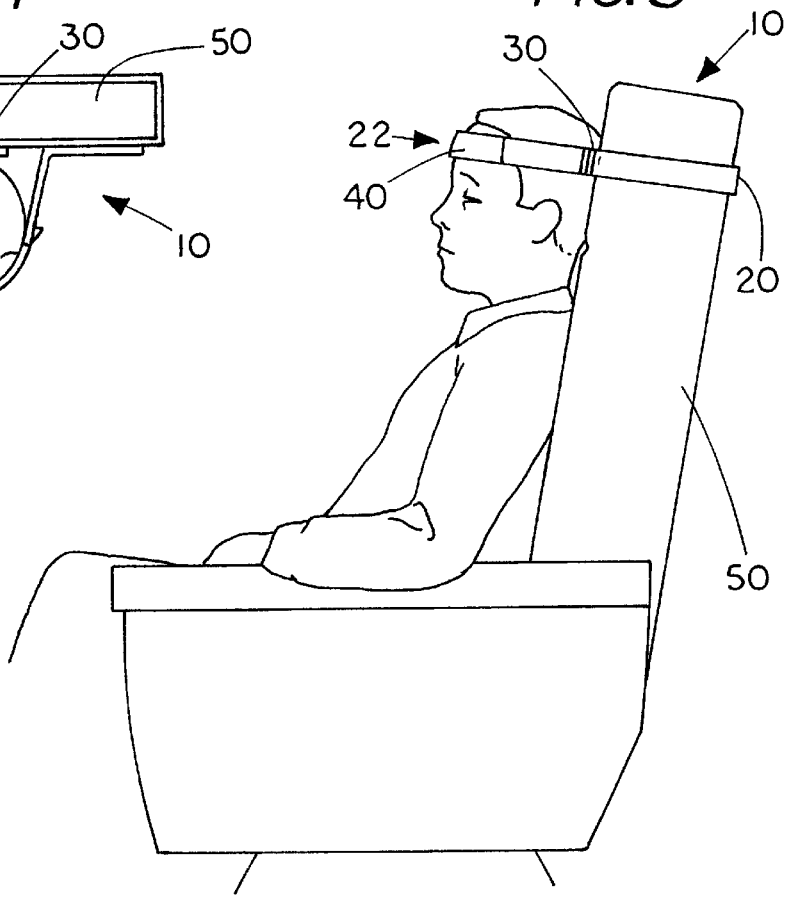
FIG. 5 is a side view of the present invention in use.

FIG. 5 shows the fully fitted application of such a head support sleeping and resting harness assembly. In FIG. 5, the full fitting also includes by side elevation, of a human figure and the full fitting of the head support sleeping and resting harness assembly to both the seat and to the head of the human figure. FIG. 5 indicates all parts having been fitted in to place on a universal seat with a headrest section. FIG. 5 also shows an aerial view of the typical universal seat with a headrest section and how such fitting is to be effected.

Referring to FIG. 1, it can be seen by the three dimensional-drawing that the present invention 10 includes a set of elongated sections of strap. The elongated sections of strap are a seat harness 20 and a head harness 22. The seat harness 20 and the head harness 22 are preferably made of non-resilient material such as nylon-type webbing. The seat harness 20 and the head harness 22 preferably have a contact surface that is highly adhesive to its opposite side. The seat harness 20 and the head harness 22 form the firm tensioning strap assembly of the present invention 10. At appropriate junctures, according to the size of the universal seat of which the present invention 10 is to be fitted, the overlapping surfaces of the seat harness 20 and the head harness 22 are laid upon each other. The seat harness 20 and the head harness 22 form a strong bonding adhesion to each other ready for fitting to a universal seat with a headrest type section.

The seat harness 20 is laterally wrapped around the headrest portion of the seat 50 and is removably attached to itself as shown in FIG. 2. This arrangement allows the present invention 10 to form a secure seat harness 20 on whatever universal seat applied thereto by the present invention 10, thereby being able to be adjusted to whatever the size of the universal seat being so harnessed to. The present invention 10 also includes a head cushion 30 attached to a portion of the seat harness 20. The head cushion 30 provides cushioning for a head to provide comfort for the back of the head when so resting against the seat harness 20. The head cushion 30 also prevents the user's head and hair from coming into contact with the naturally highly adhesive surface of the seat harness 20.

The present invention 10 includes the head harness 22 which when so bonded to the seat harness 20 provides a loop to be comfortably fitted around the head and further attached to the seat harness 20. The loop being so formed in this fashion so as to comfortably fit around the head and thereby holding the head comfortably and firmly at rest, for the purpose of sleeping and/or resting. The seat harness 20 and the head harness 22 form a harness assembly.

The present invention 10 may include a second cushioning mechanism 40. The second cushioning mechanism 40 may be any cushioning mechanism for the user's forehead. The second cushioning mechanism 40 may be a terry cloth toweling. The second cushioning mechanism 40 may be a tubular sleeve of soft cotton and/or synthetic material that is slipped over the head harness 22 so as to provide a soft cushion effect for the head. The second cushioning mechanism 40 may thereby provide the comfort and firmness required for sleeping and/or resting without pressure to the head.

In one form of the present invention 10, the harness assembly (the seat harness 20 and the head harness 22) has universal adaptability to fitting on any seat, existing or proposed. The lengths of the harness assembly are sufficiently long to be affixed to the largest of seats and may be simply modified for smaller seats (if required) by overlapping the harness assembly as required to take up the slack.

Referring to FIG. 2, it can be seen that the present invention 10 may be fitted to any typical universal seat with a headrest section. The strap assembly thereby being able to be universally adjusted to suit any seat. In one form of the present invention 10, the strap assembly has universal adaptability to fitting any seat with a headrest section existing or proposed. The lengths of the strap assembly are sufficiently long to be affixed to the largest of seats and may be simply modified for smaller seats (if required) by overlapping the strap assembly as required to take up the slack FIG. 3 shows the present invention 10 in use. The seat harness 20 can be fitted to any universal seat with a headrest by laterally wrapping this assembly around the top section of a universal passenger seat 50 thereby forming a secure seat harness 20 when fully anchored. The head harness 22 may be fitted to the seat harness 20 and thereby provide a loop to be comfortably fitted around the head. The head harness 22 is removably affixed to the seat harness 20. The loop being formed in this fashion so as to comfortably fit around the head and thereby holds the head comfortably and firmly at rest, for the purpose of sleeping and/or resting. The second cushioning mechanism 40 is so fitted so as to allow cushioning between the head harness 22 and the forehead, when fully in operation thereby providing head support, comfort and firmness.

FIG. 4 is a top elevation view of the present invention 10 in use. FIG. 4 shows the seat harness 20 laterally wrapped around a seat 50 and removably attached to itself. The head cushion 30, attached to the seat harness 20, is centered on the front of the seat 50 for comfort of the person using the present invention 10. The head harness 22 is attached at one end to the seat harness 20, wrapped across the user's forehead, and attached to the seat harness 20 at the opposite end. The second cushioning mechanism 40 is placed over the user's forehead.

Referring to FIG. 5, it can be seen by the side elevation drawing, that the present invention 10 may be fitted to any typical universal seat 50 with a headrest section. The strap assembly (the seat harness 20 and the head harness 22) may be universally adjusted to suit to any such seat. The universal seat 50 may be any seat with a headrest section. The universal seat 50 need not be shaped as shown in FIG. 5.

In one form of the invention, the present invention 10 has universal adaptability to fitting any seat with a headrest section existing or proposed. The lengths of the seat harness 20 and the head harness 22 are sufficiently long to be affixed to the largest of seats and may be simply modified for smaller seats (if required) by overlapping the seat harness 20 and the head harness 22 as required to take up the slack.

By the use of the head support sleeping and resting harness of this type, the head may be comfortably and firmly be held at rest. The head being held comfortably and firmly at rest in this manner will prevent the passenger from having to rely on neck muscle and tendon structure to support the head, preventing it from involuntarily moving. This totally eliminates the need to remain awake to support the head and thereby consequently eliminating exhaustion, tiredness and/or illness. Furthermore, the harness will prevent the head from being able to be swayed and fall in motion jerking movement, severely during travel, thereby providing total support and eliminating a potential health hazard.

Figure 6:
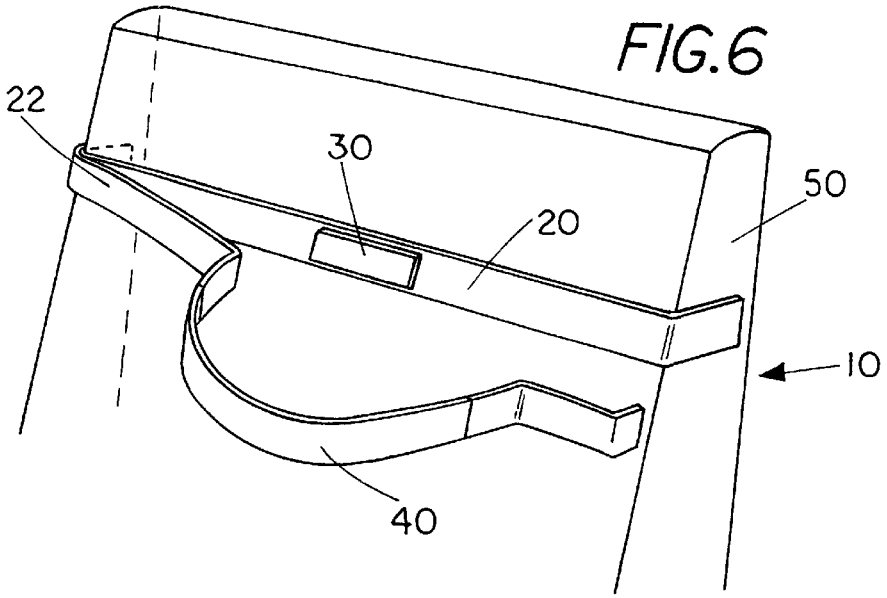
FIG. 6 is a front elevation view of the present invention.

An alternative embodiment of the present invention 10 is for the harness itself to be an integral part of the seat design and/or the seat covering materials design itself or attached thereto. Referring to FIG. 6, the seat harness 20 may be an integral part of the seat 50 design. The seat harness 20 may be an integral part of the seat cover materials design. The seat harness 20 may be fastened to the seat 50 and/or fastened to the seat cover materials. The seat harness 20 may be an extension of the seat 50 or seat cover materials and/or fastened to the seat 50 or seat cover materials by sewing, buttoning, clamping, zipping, and/or adhesively bonding in any manner whatsoever.

Although the present invention has been described with reference to preferred embodiments, workers skilled in the art will recognize changes may be made in form and detail without departing from the spirit and scope of the invention.

I claim:

1. A head support sleeping and resting harness comprising:

a first elongate section of strap forming a seat harness; the first elongated section of strap having a head cushion; the seat harness having an adhesive surface; the seat harness being laterally positioned around a headrest portion of a seat; the seat harness being secured into position by attaching one end of the seat harness to the adhesive surface; and a second elongated section of strap forming a head harness; the head harness being attached at each end to the seat harness, thereby forming a loop to be placed around the user's forehead.

2. The device in claim 1 wherein:

the adhesive surface being a hook and loop mechanism.

3. The device in claim 1 wherein:

the first and second elongated sections of strap are a nylon-type webbing material.

4. The device in claim 1 wherein:

the head cushion is permanently affixed to the first elongated section of strap.

5. The device in claim 1 wherein:

the head cushion is removably affixed to the first elongated section of strap.

6. The device in claim 4 further comprising:

the second elongated section of strap having a second cushioning mechanism.

7. The device in claim 6 wherein:

the second cushioning mechanism is a terry cloth toweling.

8. The device in claim 7 wherein:

the second cushioning mechanism is permanently attached to the second elongated section of strap.

9. The device in claim 7 wherein:

the second cushioning mechanism is removably attached to the second elongated section of strap.

10. A fully adjustable, head support sleeping and resting harness comprising:

a first and second elongated sections of strap; the first and second elongated sections of strap forming a non-resilient firm tensioning strap assembly; the first elongated section of strap having an adhesive surface; the first elongated section of strap having a head cushion; and the non-resilient firm tensioning strap assembly being anchored to a seat with a headrest type section; the first elongated section of strap being an integral part of the seat; the second elongated section being attachable to the first elongated section.

11. The device in claim 10 wherein:

the adhesive surface being a hook and loop mechanism.

12. The device in claim 10 wherein:

the first and second elongated sections of strap are a nylon-type webbing material.

13. The device in claim 1 wherein:

the head cushion is permanently affixed to the first elongated section of strap.

14. The device in claim 1 wherein:

the head cushion is removably affixed to the first elongated section of strap.

15. The device in claim 13 further comprising:

the second elongated section of strap having a second cushioning mechanism.

16. The device in claim 15 wherein:

the second cushioning mechanism is a terry cloth toweling.

17. The device in claim 16 wherein:

the second cushioning mechanism is permanently attached to the second elongated section of strap.

18. The device in claim 16 wherein:

the second cushioning mechanism is removably attached to the second elongated section of strap.

* * * * *